US006790407B2

(12) United States Patent
Fridlyander et al.

(10) Patent No.: US 6,790,407 B2
(45) Date of Patent: Sep. 14, 2004

(54) HIGH-STRENGTH ALLOY BASED ON ALUMINIUM AND A PRODUCT MADE OF SAID ALLOY

(75) Inventors: Iosif Naumovich Fridlyander, Moscow (RU); Evgeny Nikolaevich Kablov, Moscow (RU); Olga Grigorievna Senatorova, Moscow (RU); Svetlana Fedorovna Legoshina, Moscow (RU); Vladimir Nikolaevich Samonin, Samara (RU); Alexandr Juvenarievich Sukhikh, Verkhnyaya Salda (RU); Johannes Koshorst, Vigoulet-Auzil (FR)

(73) Assignees: Federalnoe Gosudarstvennoe Unitarnoe Predpriyatie "Vserossiisky auchno-Issledovatelsky Institut Aviatsionnykh Materialov", Moscow (RU); Otkrytoe Aktsionernoe Obschestvo "Samrsky Metallurgichesky Zavod", Samara (RU)

( * ) Notice: Subject to any disclaimer, the term of this patent is extended or adjusted under 35 U.S.C. 154(b) by 0 days.

(21) Appl. No.: 10/333,334

(22) PCT Filed: Jul. 25, 2001

(86) PCT No.: PCT/RU01/00307

§ 371 (c)(1),
(2), (4) Date: Jun. 25, 2003

(87) PCT Pub. No.: WO02/10468

PCT Pub. Date: Feb. 7, 2002

(65) Prior Publication Data

US 2004/0101434 A1 May 27, 2004

(30) Foreign Application Priority Data

Aug. 1, 2000 (RU) ..... 2000120274

(51) Int. Cl.[7] ..... C22C 21/10
(52) U.S. Cl. ..... 420/532; 420/535; 148/417
(58) Field of Search ..... 420/532, 535; 148/417

(56) References Cited

U.S. PATENT DOCUMENTS

| | | | | |
|---|---|---|---|---|
| 4,305,763 | A | 12/1981 | Quist et al. | 148/12.7 |
| 5,221,337 | A | 6/1993 | Luers et al. | 106/266 |

FOREIGN PATENT DOCUMENTS

| | | |
|---|---|---|
| JP | 48031807 | 10/1973 |
| JP | 61186445 | 8/1986 |
| JP | 2107739 | 4/1990 |
| JP | 4263035 | 9/1992 |
| SU | 436876 | 12/1974 |

OTHER PUBLICATIONS

RF Society "Knowledge"; Moscow House of Science & Technology Popularization Named After Dzerzhinsky; New Non–Ferrous Alloys; Seminar Proceedings; Moscow; 1990; p. 33.

Aluminum Standards and Data 1998 Metric Si; Third Edition Apr. 1998; The Aluminum Association Incorporated; p. 6–6.

*Primary Examiner*—Roy King
*Assistant Examiner*—Janelle Morillo
(74) *Attorney, Agent, or Firm*—Ladas & Parry

(57) ABSTRACT

The present invention relates to high-strength aluminium-based alloy of Al—Zn—Mg—Cu system and the article made thereof. Said alloy can be used as a structural material in aircraft- and rocket engineering, and for fabricating the articles for transportation- and instrument engineering.

The advantage of the suggested alloy is its high strength and the required level of service properties combined with sufficient technological effectiveness necessary for fabricating various wrought semiproducts, mainly of large sizes. Said alloy has the following composition (in wt %):

| | |
|---|---|
| zinc | 7.6–8.6 |
| magnesium | 1.6–2.3 |
| copper | 1.4–1.95 |
| zirconium | 0.08–0.20 |
| manganese | 0.01–0.1 |
| iron | 0.02–0.15 |
| silicon | 0.01–0.1 |
| chrome | 0.01–0.05 |
| nickel | 0.0001–0.03 |
| beryllium | 0.0001–0.005 |
| bismuth | 0.00005–0.0005 |
| hydrogen | $0.08 \times 10^{-5}$–$2.7 \times 10^{-5}$ |

and at least one element from the group including

| | |
|---|---|
| titanium | 0.005–0.05 |
| boron | 0.001–0.01 |
| aluminium - | balance. |

The following conditions should be observed:

the sum of zinc, magnesium, copper should not exceed 12.5%;

the sum of zirconium, manganese, chrome and nickel should not exceed 0.35%;

the ratio Fe:Si should not be less than 1.2.

Said alloy is recommended for use as a structural material for main members of aircraft airframe (upper skin, stringers of the wing, loaded beams, etc.

9 Claims, No Drawings

HIGH-STRENGTH ALLOY BASED ON ALUMINIUM AND A PRODUCT MADE OF SAID ALLOY

FIELD OF THE INVENTION

The present invention relates to non-ferrous metallurgy, and in particular it relates to high strength alloys of Al—Zn—Mg—Cu system used as a structural material for main parts in aircraft (upper skins and stringers of the wing, loaded beams, etc), in rocket-, transportation and instrument engineering.

BACKGROUND OF THE INVENTION

Well-known are high strength aluminium-based alloys of Al—Zn—Mg—Cu system additionally doped with a minor amount of zirconium.

The Russian alloy 1973 has the following composition (in weight %):

| | |
|---|---|
| zinc | 5.6–6.5 |
| magnesium | 2.0–2.6 |
| copper | 1.4–2.0 |
| zirconium | 0.08–0.16 |
| titanium | 0.02–0.07 |
| manganese | ≦0.10 |
| chrome | ≦0.05 |
| iron | ≦0.15 |
| silicon | ≦0.10 |
| aluminium - | balance [1] |

The American alloy 7050 comprises (wt %):

| | |
|---|---|
| zinc | 5.7–6.7 |
| magnesium | 1.9–2.6 |
| copper | 2.0–2.6 |
| zirconium | 0.08–0.15 |
| titanium | ≦0.06 |
| manganese | ≦0.10 |
| chrome | ≦0.04 |
| iron | ≦0.15 |
| silicon | ≦0.12 |
| aluminium - | balance [2] |

Also is patented the American alloy comprising (wt %):

| | |
|---|---|
| zinc | 5.9–6.9 |
| magnesium | 2.0–2.7 |
| copper | 1.9–2.5 |
| zirconium | 0.08–0.15 |
| titanium | ≦0.06 |
| chrome | ≦0.04 |
| iron | ≦0.15 |
| silicon | ≦0.12 |
| aluminium - | balance [3] |

The common disadvantage of all said alloys is the unsatisfactory level of static strength and specific characteristics which doesn't allow to improve service properties, to increase the weight efficiency of the articles aiming to raise carrying capacity, to save fuel, to increase flight distance range, etc.

The American alloy is suggested comprising (wt %):

| | |
|---|---|
| zinc | 7.6–8.4 |
| magnesium | 1.8–2.2 |
| copper | 2.1–2.6 |
| zirconium | 0.03–0.30 |
| manganese | 0.1–0.35 |
| iron | 0.03–0.1 |
| silicon | 0.03–0.1 |

and at least one element from the group including

| | |
|---|---|
| halfnium | 0.03–0.4 |
| vanadium | 0.05–0.15 |
| aluminium - | balance [4] |

Said alloy has the following disadvantages:

- high and superhigh strength is mainly achieved by heavy alloying with main elements—zinc, magnesium, copper (their maximum sum >13.0%), but the increased amount of copper leads to the reduction of ductility, crack—and fatigue resistance;
- the additional alloying with expensive elements (hafnium, vanadium) is used, and that leads to the increase in cost of semi-finished products and finished articles, especially when there is a large-scale production and the products are of large sizes;
- the alloy has the unsatisfactory ductility in as-cast condition (and therefore has the tendency to appearing of cracks in ingots especially large-sized ingots which are cast from such alloys with difficulty) and under the deformation of semiproducts;
- the alloy's composition doesn't provide the optimum conditions of the microstructure formation and service characteristics of such members as skins and stringers of the wing which are needed for modem and future aircraft.

DESCRIPTION OF THE INVENTION

The object of the present invention is to provide an alloy having high strength and the desired level of service characteristics necessary for main loaded members of airframe in aircraft, rockets and other articles, in combination with satisfactory technological effectiveness for fabrication of various wrought semiproducts especially of large sizes.

According to the invention, there is provided the high strength aluminium-based alloy of Al—Zn—Mg—Cu system comprising (in wt %):

| | |
|---|---|
| zinc | 7.6–8.6 |
| magnesium | 1.6–2.3 |
| copper | 1.4–1.95 |
| zirconium | 0.08–0.20 |
| manganese | 0.01–0.1 |
| iron | 0.02–0.15 |
| silicon | 0.01–0.1 |
| chrome | 0.01–0.05 |
| nickel | 0.0001–0.03 |
| beryllium | 0.0001–0.005 |
| bismuth | 0.00005–0.0005 |
| hydrogen | $0.08 \times 10^{-5}$–$2.7 \times 10^{-5}$ |

and at least one element from the group consisting of

| | |
|---|---|
| titanium | 0.005–0.06 |
| boron | 0.001–0.01 |
| aluminium - | balance, |

and the article made thereof.

The sum of the main alloying elements (zinc, magnesium, copper) should not exceed 12,5%. The sum of the transition elements (Zr, Mn, Cr, Ni) should not exceed 0,35%. The ratio Fe: Si should be not less than 1.2.

Together with the main element-antirecrystallizer Zr, the introduction of Cr, Ni into the suggested alloy's composition, and the reduction of Mn amount (the claimed range of the total sum be not more than 0,35%) ensures the formation and stabilization of unrecrystallized structure, nucleation of hardening phases and hence, the increase in strength, and also raises the stress corrosion cracking resistance and exfoliation corrosion resistance.

The microalloying of the alloy with grain refining titanium additive of nucleation sites effect and/or boron additive causes the heterogenious solidification of the alloy and hence, grain refining and its uniformity, secondary phases' dispersion in ingots. Bismuth also has a grain refining effect and it increases the fluidity. All of said improve the ductility of ingots and semiproducts, and extend the possibility to enlarge their dimensions and to increase the quality.

Hydrogen being present in microamounts, promotes the formation of fine-grain structure, uniform distribution of inevitable non-metallic inclusions through the volume of ingots and semiproducts, and the increase in their ductility. The inclusion of a technological additive of beryllium reduces the oxidability and improves the fluidity in casting process, additionally improving the quality of ingots and semiproducts.

It is quite necessary to exceed the amount of iron over the amount of silicon (by more than 1,2 times) while strictly limiting these amounts (especially of silicon), for the purpose of improving the casting properties of Zn-containing alloys in order to make possible the fabrication of large-sized ingots and semiproducts.

The reduction of copper amount (to 1.95 wt %) and of total degree of alloying with main elements (Zn, Mg, Cu) to 12.5 wt % suppresses the possibility of formation of coarse excessive insoluble intermetallics like $S(Al_2CuMg)$ phase etc, and limits their unfavourable influence upon ductility, crack resistance and fatigue, while not reducing the corrosion resistance.

Embodiments of the present invention will now be described by way of examples.

EXAMPLES

In experimental trials the ingots were cast, and Table 1 shows the compositions of the alloys. The alloys 1–6 are the alloys according to the present invention, and alloy 7 is the example of the invention of U.S. Pat. No. 5,221,337. The ingots had the diameter of 110 mm. They were cast by semi-continuous method with water cooling. Casting was performed in electric furnace. After homogenization at 460° C. for 24 hours, the values of ingots' ductility were estimated, which values characterize the ingots' ability to hot deformation at typical temperature of 400° C. in semiproducts' fabrication process. Two methods were used: upset forging of the samples Ø 15×20 mm with the determination of ultimate deformation $\epsilon$; tensile testing of round samples (gauge length diameter $d_o$=4 mm) with the determination of relative elongation $\delta$ (upon gauge length $l_o=5d_o$) and relative reduction of area $\psi$.

The average grain size $d_{aver}$ in the ingots were determined by the method of quantitative metallography of polarized microsections.

After homogenization some of the ingots were extruded at 390–410° C. into bars of 12×75 mm cross-section. The billets of extruded bars were solution treated from temperature of 467° C. (for 50 minutes) and quenched in cold water (20–25° C.). In the range of 4 hours after quenching the bars were subjected to artificial ageing of $T_1$ according to the scheme: 140° C., 16 hours.

The mechanical and corrosion properties were determined on samples cut from bars.

The mechanical properties upon tensile testing (tensile strength, elongation, reduction in area) were determined on round specimen with gauge length diameter $d_o$=5 mm. Crack resistance was estimated by impact toughness of a specimen with V-shaped notch and a fatigue crack according to GOST 9454.

Low cycle fatigue resistance (LCF) was estimated by time to fracture of the round longitudinal specimen with circular notch ($K_t$=2.2) under high stress ($\sigma_{max}$=0.7 UTS of notched specimen) and frequency f=0.17 Hz.

The corrosion properties were estimated by:

- stress corrosion cracking resistance (SCC) by time to fracture of long transverse specimens under stress $\sigma$=0.75 YTS and under other conditions according to GOST 9.019;
- exfoliation corrosion resistance (EXCO) of flat longitudinal specimens on 10-ball scale according to GOST 9.904.

Table 2 illustrates the combination of mechanical and corrosion properties of extruded bars made of suggested alloy and of the prior art alloy. Table 3 shows the values of technological ductility of the ingots made from said alloys.

As one can evidently see from the shown results, the composition of the claimed alloy allowed to increase noticeably the values of ductility and crack resistance (by ≈15–20%) while providing the high level of strength properties, preserving the stress corrosion resistance and improving to some extent the exfoliation corrosion—and fatigue resistance. Said composition provides the improvement in structure and technological ductility of ingots, making the casting process and the forming of the semiproducts easy.

Thus, the claimed alloy provides the increase in weight effectiveness, reliability and service life of the articles. The alloy is recommended for fabrication of rolled (sheets, plates), extruded (profiles, panels, etc) semiproducts including long-sized products from large ingots, and also forged semiproducts (die forgings and hand forgings).

Said alloy may be used as structural material for fabricating the main members of airframe in aircraft, especially in compressed zones (upper skins and stringers of the wing, loaded beams, etc), rockets and other articles.

TABLE 1

Chemical compositions of the alloys

| Alloy | Zn | Mg | Cu | Zr | Mn | Cr | Ni | Ti | B | Be | Bi | Fe | Si | $H \cdot 10^{-5}$ |
|---|---|---|---|---|---|---|---|---|---|---|---|---|---|---|
| 1 | 8.3 | 2.3 | 1.9 | 0.13 | 0.1 | 0.04 | 0.005 | 0.05 | — | 0.005 | 0.0002 | 0.1 | 0.04 | 0.8 |
| 2 | 8.6 | 2.1 | 1.4 | 0.14 | 0.07 | 0.04 | 0.008 | — | 0.008 | 0.002 | 0.0005 | 0.15 | 0.05 | 1.5 |
| 3 | 7.6 | 2.0 | 1.95 | 0.17 | 0.1 | 0.05 | 0.03 | 0.06 | 0.001 | 0.0001 | 0.0001 | 0.14 | 0.06 | 2.7 |
| 4 | 8.0 | 1.9 | 1.8 | 0.13 | 0.06 | 0.03 | 0.0001 | 0.005 | 0.01 | 0.003 | 0.00008 | 0.13 | 0.04 | 2.0 |
| 5 | 8.1 | 2.0 | 1.9 | 0.08 | 0.07 | 0.05 | 0.02 | 0.05 | — | 0.002 | 0.0003 | 0.12 | 0.1 | 1.8 |
| 6 | 7.9 | 1.6 | 1.7 | 0.20 | 0.01 | 0.01 | 0.01 | 0.04 | 0.003 | 0.001 | 0.00005 | 0.02 | 0.01 | 1.4 |
| 7 | 8.4 | 2.2 | 2.5 | 0.12 | 0.1 | 0.02 Hf | 0.15 V | — | — | — | — | 0.1 | 0.06 | — |

Note:
alloys 1–6 = claimed; 7 = alloy described in U.S. Pat. No. 5,221,337

TABLE 2

Mechanical and corrosion properties of the semiproducts

| Alloy | MPa UTS | MPa YTS | % E1 | % Reduction of area | Impact toughness J/cm$^2$ | LCF, cycle number to fracture | SCC, time to fracture, hour | EXCO, point |
|---|---|---|---|---|---|---|---|---|
| 1 | 690 | 670 | 10.0 | 16.5 | 4.0 | 1100 | 174 | 6 |
| 2 | 685 | 665 | 10.5 | 18 | 4.3 | 1040 | 172 | 6 |
| 3 | 675 | 655 | 11.5 | 20 | 4.6 | 1200 | 180 | 6 |
| 4 | 685 | 665 | 11.0 | 20 | 4.5 | 1150 | 173 | 7 |
| 5 | 680 | 660 | 10.5 | 19 | 4.4 | 1040 | 174 | 7 |
| 6 | 685 | 665 | 10.0 | 17 | 4.2 | 1100 | 175 | 6 |
| 7 | 690 | 670 | 9.0 | 15 | 3.8 | 1050 | 173 | 7 |

TABLE 3

Technological ductility of ingots at 400° C.

| Alloy | Average grain Size, $d_{aver}$, $\mu$m | Upset forging $\epsilon$, % | Tension E1, $\delta$ | Tension Reduction, $\psi$ % |
|---|---|---|---|---|
| 1 | 260 | 49 | 74 | 92 |
| 2 | 230 | 55 | 76 | 93 |
| 3 | 210 | 60 | 82 | 95 |
| 4 | 320 | 48 | 74 | 92 |
| 5 | 250 | 55 | 75 | 93 |
| 6 | 270 | 50 | 74 | 93 |
| 7 | 380 | 43 | 71 | 90 |

What is claimed is:

1. High strength aluminium-based alloy comprising (wt %):

| | |
|---|---|
| zinc | 7.6–8.6 |
| magnesium | 1.6–2.3 |
| copper | 1.4–1.95 |
| zirconium | 0.08–0.20 |
| manganese | 0.01–0.1 |
| iron | 0.02–0.15 |
| silicon | 0.01–0.1 |
| chromium | 0.01–0.05 |
| nickel | 0.0001–0.03 |
| beryllium | 0.0001–0.005 |
| bismuth | 0.00005–0.0005 |
| hydrogen | $0.08 \times 10^{-5}$–$2.7 \times 10^{-5}$ |

and at least one element from the group including

| | |
|---|---|
| titanium | 0.005–0.06 |
| boron | 0.001–0.01; |
| aluminium - | balance. |

2. High strength aluminium-based alloy of claim 1, characterized in that the sum of zinc, magnesium and copper should not exceed 12.5%.

3. High strength aluminum-based alloy of claim 2, characterized in that the sum of zirconium, manganese, chromium, and nickel should not exceed 0.35%.

4. High strength aluminum-based alloy of claim 3, characterized in that the ratio Fe:Si should be not less than 1.2.

5. High strength aluminium-based alloy of claim 2, characterized in that the ratio Fe:Si should be not less than 1.2.

6. High strength aluminum-based alloy of claim 1, characterized in that the sum of zirconium, manganese, chromium, and nickel should not exceed 0.35%.

7. High strength aluminium-based alloy of claim 6, characterized in that the ratio Fe:Si should be not less than 1.2.

8. High strength aluminium-based alloy of claim 1, characterized in that the ratio Fe:Si should be not less than 1.2.

9. The article made of high strength aluminium-based alloy, characterized in that said article is made of the alloy comprising (wt %):

| | |
|---|---|
| zinc | 7.6–8.6 |
| magnesium | 1.6–2.3 |
| copper | 1.4–1.95 |
| zirconium | 0.08–0.20 |
| manganese | 0.01–0.1 |
| iron | 0.02–0.15 |

-continued

| | |
|---|---|
| silicon | 0.01–0.1 |
| chromium | 0.01–0.05 |
| nickel | 0.0001–0.03 |
| beryllium | 0.0001–0.005 |
| bismuth | 0.00005–0.0005 |
| hydrogen | $0.08 \times 10^{-5}$–$2.7 \times 10^{-5}$ |

and at least one element from the group including

| | |
|---|---|
| titanium | 0.005–0.06 |
| boron | 0.001–0.01; |
| aluminium - | balance. |

* * * * *

UNITED STATES PATENT AND TRADEMARK OFFICE

CERTIFICATE OF CORRECTION

PATENT NO. : 6,790,407 B2 
DATED : September 14, 2004
INVENTOR(S) : Iosif Naumovich Fridlyander et al.

It is certified that error appears in the above-identified patent and that said Letters Patent is hereby corrected as shown below:

Title page,
Item [73], Assignees, "auchno" should read -- nauchno -- and, "Samrsky" should read -- Samarsky --

Signed and Sealed this

Fifth Day of April, 2005

JON W. DUDAS
*Director of the United States Patent and Trademark Office*